US011326285B2

(12) United States Patent
Ueda et al.

(10) Patent No.: US 11,326,285 B2
(45) Date of Patent: May 10, 2022

(54) LOWER THREAD WINDING DEVICE

(71) Applicant: BROTHER KOGYO KABUSHIKI KAISHA, Nagoya (JP)

(72) Inventors: Daisuke Ueda, Seto (JP); Naoki Kawamoto, Kasugai (JP); Nobuhiko Funato, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 27 days.

(21) Appl. No.: 16/924,614

(22) Filed: Jul. 9, 2020

(65) Prior Publication Data

US 2020/0340159 A1 Oct. 29, 2020

Related U.S. Application Data

(63) Continuation of application No. PCT/JP2018/047488, filed on Dec. 25, 2018.

(30) Foreign Application Priority Data

Jan. 29, 2018 (JP) ..... JP2018-012375

(51) Int. Cl.
*D05B 59/00* (2006.01)

(52) U.S. Cl.
CPC ..... *D05B 59/00* (2013.01)

(58) Field of Classification Search
CPC ..... D05B 59/00; D05B 57/265; B65H 54/18
See application file for complete search history.

(56) References Cited

U.S. PATENT DOCUMENTS

2003/0010270 A1* 1/2003 Hayashi ..... D05B 3/02 112/279
2009/0050039 A1* 2/2009 Wakazono ..... D05B 59/00 112/279
2010/0147989 A1* 6/2010 Fukao ..... B65H 54/12 242/484.7
2018/0127907 A1* 5/2018 Shiraishi ..... D05B 59/02

FOREIGN PATENT DOCUMENTS

JP 2002-066184 A 3/2002
JP 2017-131436 A 8/2017

OTHER PUBLICATIONS

Aug. 4, 2020 International Preliminary Report on Patentability issued in International Patent Application No. PCT/JP2018/047488.
Apr. 2, 2019 International Search Report issued in International Patent Application No. PCT/JP2018/047488.

* cited by examiner

*Primary Examiner* — Nathan E Durham
(74) *Attorney, Agent, or Firm* — Oliff PLC

(57) ABSTRACT

In a lower thread winding device, a motor rotates a thread winding shaft on which a bobbin is mounted. A sensor lever includes a contact portion contactable with a lower thread wound on the bobbin, and a cam piece. A contact includes a pin configured to contact the cam piece and rotates between a first position at which the pin contacts a first outer peripheral portion of the cam piece, and a second position at which the pin contacts a second outer peripheral portion of the cam piece. A lever shifts a position of the pin located when the contact is at the first position. The controller drives the motor when the contact is at the first position and stops driving the motor upon receipt of a detection result, by the detector, indicating that the contact is at the second position.

8 Claims, 6 Drawing Sheets

LOWER THREAD WINDING DEVICE

CROSS-REFERENCE TO RELATED APPLICATION

This is a continuation application of International Application No. PCT/JP2018/047488 filed on Dec. 25, 2018 which claims priority from Japanese Patent Application No. 2018-012375 filed on Jan. 29, 2018. The entire contents of the earlier applications are incorporated herein by reference.

TECHNICAL FIELD

Aspects of the disclosure relate to a lower thread winding device for winding a lower thread on a bobbin.

BACKGROUND

A known lower thread winding device includes a shaft, a motor, a distance measuring sensor. A bobbin is mounted on the shaft. The motor is coupled to the shaft. When the motor is driven, a lower thread is wound on the bobbin. The distance measuring sensor faces the bobbin along an axial direction of the shaft. When the outside diameter of the lower thread wound on the bobbin reaches a predetermined outside diameter, a voltage, which is a detection result by the distance measuring sensor, changes. Upon occurrence of a change in the detection result by the distance measuring device, the lower thread winding device stops driving the motor.

SUMMARY

However, in the known lower thread winding device, the motor continues to be driven until the outside diameter of the lower thread wound on the bobbin reaches the predetermined outside diameter, and the amount of lower thread to be wound on the bobbin is not adjustable. The amount of lower thread wound on the bobbin by the lower thread winding device may exceed or fall short of the amount desired by a user.

Aspects of the disclosure provide a lower thread winding device which allows a user to adjust the amount of lower thread to be wound on a bobbin.

According to one or more aspects of the disclosure, a lower thread winding device for winding a lower thread on a bobbin includes, a thread winding shaft on which the bobbin is mounted, a motor configured to rotate the thread winding shaft, a sensor lever rotatable about a first rotation shaft, a contact rotatable about a second rotation shaft different from the first rotation shaft, a detector, a lever, and a controller. The sensor lever includes a contact portion and a cam piece. The contact portion is contactable with the lower thread wound on the bobbin and configured to rotate about the first rotation shaft in a direction toward the bobbin and in a direction away from the bobbin. The cam piece is formed along a rotation direction about the first rotation shaft and includes a first outer peripheral portion and a second outer peripheral portion. A distance between the second outer peripheral portion and the first rotation shaft changes along the rotation direction. The contact includes a pin configured to contact the cam piece. The contact is configured to, when the sensor lever rotates in a rotation direction in which the contact portion moves away from the bobbin, rotate from a first position at which the pin contacts the first outer peripheral portion to a second position at which the pin contacts the second outer peripheral portion.

The detector configured to output different detection results, depending on whether the contact is at the first position or at the second position. The lever is coupled to the contact and configured to shift a position of the pin located when the contact is at the first position in a direction toward the second outer peripheral portion and in a direction away from the second outer peripheral portion. The controller is configured to, when the contact is at the first position, drive the motor in a driving direction in which the lower thread is wound on the bobbin, and the controller is configured to, upon receipt of a detection result indicating that the contact is at the second position, stop driving the motor.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

A lower thread winding device 5 according to an illustrative embodiment of the disclosure will be described.

Figure 1:
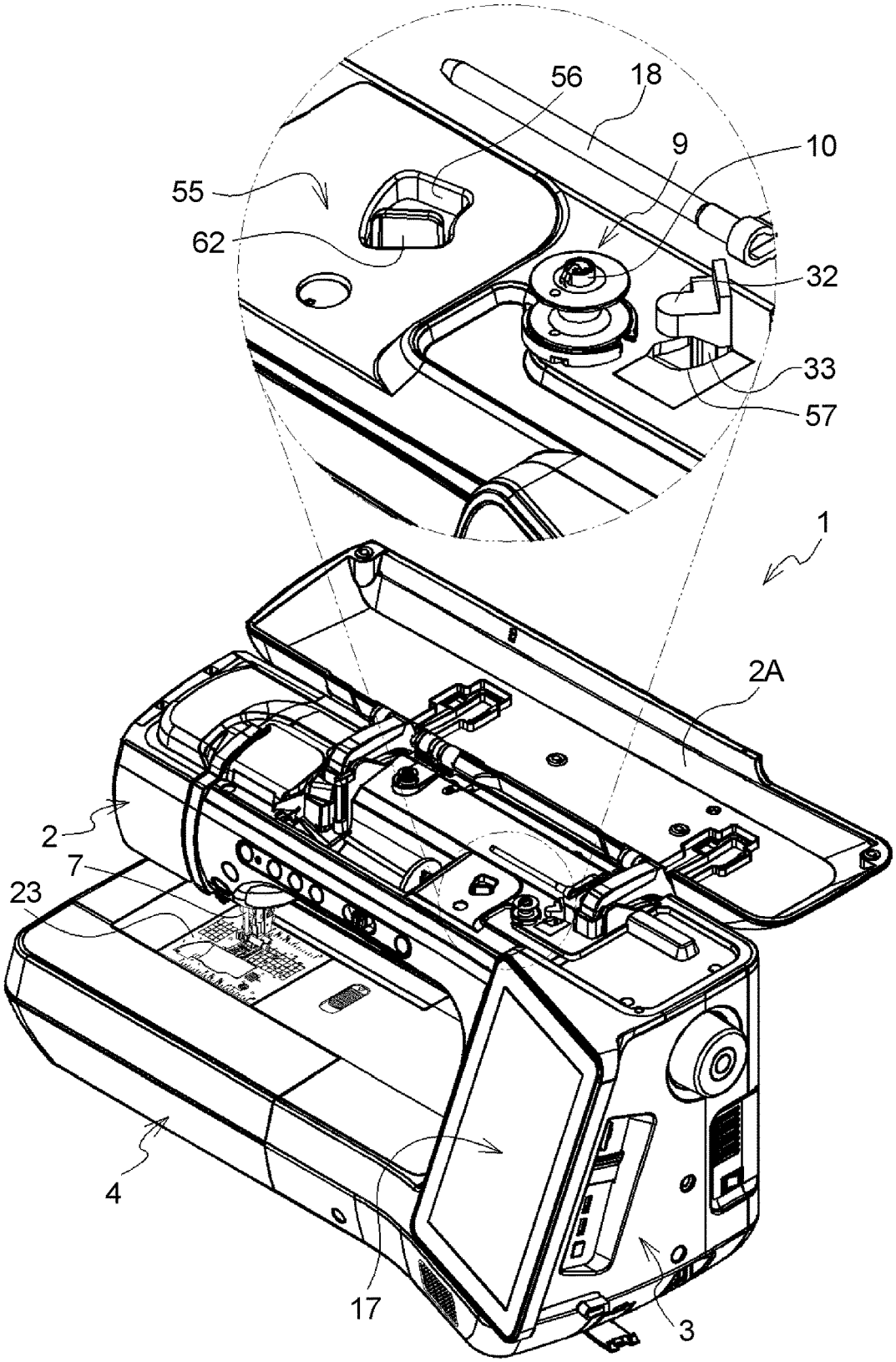
FIG. 1 is a perspective view of a sewing machine according to an illustrative embodiment of the disclosure.

As shown in FIG. 1, a sewing machine 1 includes a bed 4, an upright arm 3, and a horizontal arm 2. The upright arm 3 extends upward from the bed 4. The horizontal arm 2 extends horizontally from an upper end of the upright arm 3. A needle plate 23 is disposed on the bed 4. The needle plate 23 has a needle hole and the like. The bed 4 includes therein a shuttle mechanism (not shown). A shuttle of the shuttle mechanism is disposed below the needle plate 23 and accommodates therein a bobbin 9 on which a lower thread 22 (shown only in FIGS. 2 and 3) is wound. The bobbin 9 includes a pair of flanges facing each other and a cylinder connecting the pair of flanges. A cylindrical hole of the cylinder penetrates the pair of flanges. The lower thread 22 is wound on the cylinder. The upright arm 3 includes an operation unit 17. The operation unit 17 includes a liquid crystal display and a touchscreen disposed on a surface of the liquid crystal display. A user pushes the operation unit 17 with a finger or a stylus.

An openable cover 2A is rotatably disposed at an upper end of the horizontal arm 2. The openable cover 2A is rotated to open and close the inside of the horizontal arm 2. The horizontal arm 2 includes therein a main shaft driven by a sewing machine motor (not shown). The horizontal arm 2 includes, at its distal end, a needle bar 7 which vertically moves by rotation of the main shaft. A needle is attached to a lower end of the needle bar 7. An upper thread (not shown) is inserted into an eye (not shown) formed at a lower end of the needle. As the needle bar 7 vertically moves, the needle passes through the needle hole. The upper thread is caught by the shuttle driven in response to the needle bar 7 and then entangled with the lower thread 22 drawn from the bobbin 9.

The horizontal arm 2 includes therein a lower thread winding device 5 and a spool pin 18. The lower thread winding device 5 winds a lower thread 22 on the bobbin 9. The spool pin 18 holds a thread spool which supplies a lower thread 22 to the lower thread winding device 5. Upon insertion of the spool pin 18 into a through-hole of the thread spool, the thread spool is held by the spool pin 18.

Figure 2:
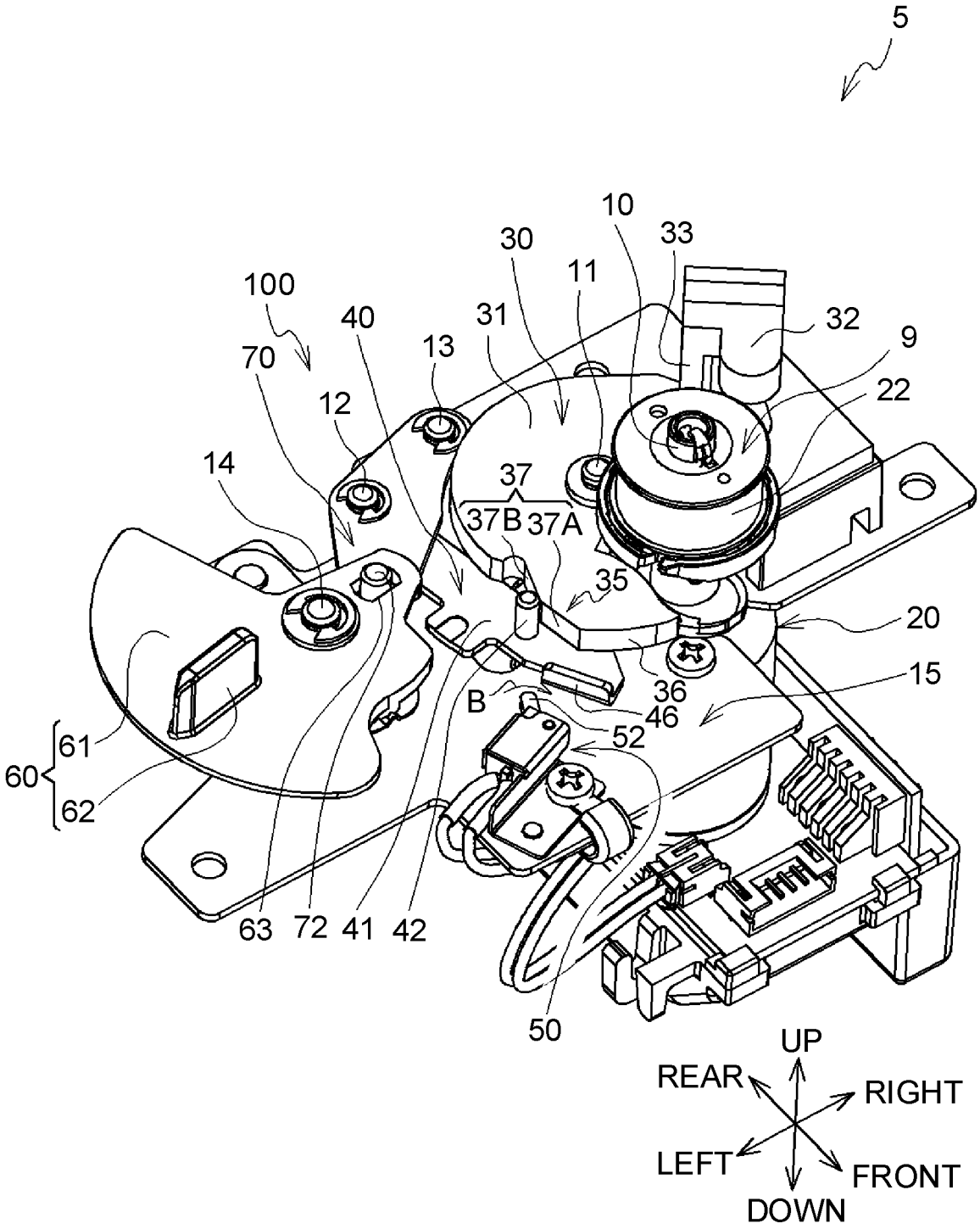
FIG. 2 is a perspective view of a lower thread winding device.

Referring to FIG. 2, the lower thread winding device 5 will be described. In the following description, a front-rear direction, a left-right direction, and a vertical direction, which are shown by arrows in the drawings, are used. The lower thread winding device 5 includes a frame 15, a motor 20, a sensor lever 30, a contact 40, an urging member 16 (refer to FIG. 3), a link 70, a lever 60, a cover 55 (refer to FIG. 1), and a detector 50.

The frame 15 is plate-shaped to have a thickness in the vertical direction and is fixed inside the horizontal arm 2. The motor 20 is fixed to a lower surface of the frame 15. A drive shaft (not shown) of the motor 20 penetrates the frame 15 and extends upward. A thread winding shaft 10 extends upward from the drive shaft. The cylindrical hole of the cylinder of the bobbin 9 is put around the thread winding shaft 10. The thread winding shaft 10 and the bobbin 9 are driven by the motor 20 to rotate integrally.

The sensor lever 30 is disposed rotatably about a first rotation shaft 11 which protrudes upward from the frame 15. The first rotation shaft 11 is disposed behind the bobbin 9. The sensor lever 30 includes a base 31, an extending portion 33, a contact portion 32, and a cam piece 35. The base 31 is substantially disc-shaped to have a thickness in the vertical direction and is rotatably coupled to the first rotation shaft 11. The extending portion 33 protrudes upward from the base 31. The contact portion 32 protrudes, along a rotation direction about the first rotation shaft 11, from an upper end of the extending portion 33 toward the thread winding shaft 10. As the sensor lever 30 rotates, the contact portion 32 rotates about the first rotation shaft 11 in a direction toward the bobbin 9 and in a direction away from the bobbin 9.

The cam piece 35 is formed at an outer peripheral portion on the left of the base 31, along the rotation direction about the first rotation shaft 11. The cam piece 35 includes a first outer peripheral potion 36 and a second outer peripheral portion 37. The first outer peripheral portion 36 and the second outer peripheral portion 37 are arranged in this order, about the first rotation shaft 11, from a more counterclockwise position to a more clockwise position in plan view. The first outer peripheral portion 36 and the second outer peripheral portion 37 each have such a shape that a distance from the first rotation shaft 11 changes along the rotation direction about the first rotation shaft 11. In this illustrative embodiment, a distance between the first outer peripheral portion 36 and the first rotation shaft 11 and a distance between the second outer peripheral portion 37 and the first rotation shaft 11 each decrease toward a more clockwise position about the first rotation shaft 11 in plan view. The first outer peripheral portion 36 extends in a curved manner, and the second outer peripheral portion 37 extends straight. The second outer peripheral portion 37 includes flat surfaces 37A and 37B. The flat surface 37A is connected, at its one end, to an end of the first outer peripheral portion 36 and, at its other end, to an end of the flat surface 37B.

Figure 3:
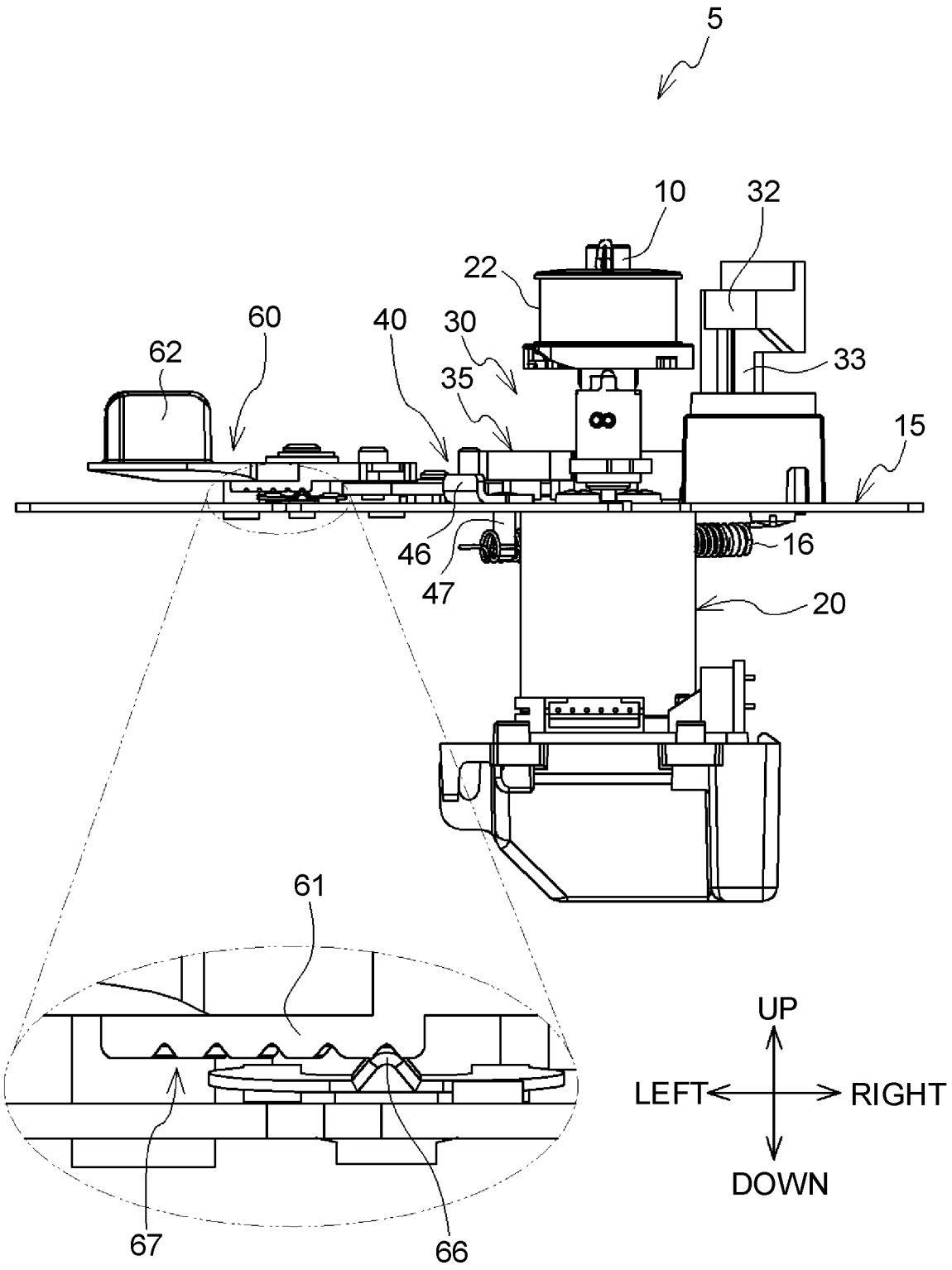
FIG. 3 is a front view of the lower thread winding device.

The contact 40 includes a base 41, a pin 42, a switch contact portion 46, and a lower protrusion 47 (refer to FIG. 3). The base 41 is substantially rectangular plate-shaped in plan view and movably disposed on an upper surface of the frame 15. The base 41 includes, at its rear, a second rotation shaft 12 which protrudes upward. The base 41 is rotatable relative to the second rotation shaft 12. The pin 42 is located in front of the second rotation shaft 12 and protrudes upward from the base 41. The pin 42 contacts the cam piece 35. The switch contact portion 46 protrudes upward from a front peripheral end of the base 41. The switch contact portion 46 is elongate plate-shaped and contactable with a movable portion 52 of a detector 50 to be described later. The lower protrusion 47 (refer to FIG. 3) protrudes downward from the base 41 to penetrate the frame 15.

An urging member 16 (refer to FIG. 3) urges the contact 40 in a rear-right direction and is coupled to a lower end of the lower protrusion 47 and to a lower portion of the frame 15. The urging member 16 is, for example, a tension spring. The pin 42 is urged by the urging member 16 to contact the cam piece 35.

As shown in FIG. 2, the link 70 is elongate plate-shaped to have a thickness in the vertical direction and is positioned above the contact 40. A substantially central portion of the link 70 is rotatably coupled to the second rotation shaft 12. One end of the link 70 is rotatable about a third rotation shaft 13 which protrudes upward from the frame 15. The third rotation shaft 13 is disposed behind the sensor lever 30. A protruding pin 72 is fixed to the other end of the link 70 to extend upward. A distance (which corresponds to a dimension L1 shown in FIG. 5A) between the second rotation shaft 12 and the third rotation shaft 13 is less than a distance (which corresponds to a dimension L2 shown in FIG. 5A) between the third rotation shaft 13 and the protruding pin 72.

The lever 60 is disposed rotatably about a fourth rotation shaft 14 which protrudes upward from the frame 15. The fourth rotation shaft 14 is disposed to the left of the contact 40. The lever 60 includes a base 61 and a handle 62. The base 61 is plate-shaped to have a thickness in the vertical direction and is rotatably coupled to the fourth rotation shaft 14. The base 61 is disposed above the link 70. The base 61 has, at its right portion, a coupling hole 63. The coupling hole 63 is a slot elongate in a radial direction relative to the fourth rotation shaft 14 and penetrates the base 61 in a thickness direction. The protruding pin 72 of the link 70 is slidably fitted in the coupling hole 63. Thus, rotation of the lever 60 allows the link 70 to rotate about the third rotation shaft 13. The handle 62 is plate-shaped to have a thickness in a rotation direction about the fourth rotation shaft 14 and protrudes upward from a left portion of the base 61. The handle 62 is aligned with the coupling hole 63 while sandwiching the fourth rotation shaft 14 therebetween. The handle 62 protrudes upward from the base 61.

In the following description, the link 70, the coupling hole 63, and the protruding pin 72 are collectively referred to as a "link mechanism 100". The link mechanism 100 is coupled to the lever 60 and the contact 40 to transmit a rotational moving force of the lever 60 to the contact 40. The contact 40 shifts, due to the force transmitted by the link mechanism 100, in a substantially front-rear direction.

As shown in FIG. 3, the base 61 of the lever 60 includes, on its lower surface, irregularities 67. The irregularities 67 include bumps and dents which are alternately arranged along a rotation direction of the lever 60. In other words, the irregularities 67 extend in the rotation direction of the lever 60. A contact member 66 slidably contacts the irregularities 67. In this illustrative embodiment, the contact member 66 is an end of a leaf spring fixed to an upper surface of the frame 15. The contact member 66 press-contacts the irregularities 67. The contact member 66 is fitted in a dent of the irregularities 67 and the lever 60 is retained at the frame 15.

Referring to FIG. 1, the cover 55 will be described. The cover 55 is substantially box-shaped to be open downward. The cover 55 includes a first opening 56, a second opening 57, and a third opening (not shown). The first opening 56, the second opening 57, and the third opening are each open in the vertical direction. The handle 62 is inserted in the first opening 56, the extending portion 33 is inserted in the second opening 57, and the thread winding shaft 10 is inserted in the third opening. The handle 62, the extending portion 33, and the thread winding shaft 10 each extend upward from the cover 55 and are exposed inside the horizontal arm 2. The bobbin 9 and the contact portion 32 are also exposed inside the horizontal arm 2. On the other hand, the cover 55 covers, from above, the base 61 of the lever 60, the link mechanism 100, the contact 40, the base 31 of the sensor lever 30, and the detector 50 (to be described later), which are shown in FIG. 2.

Figure 5A:
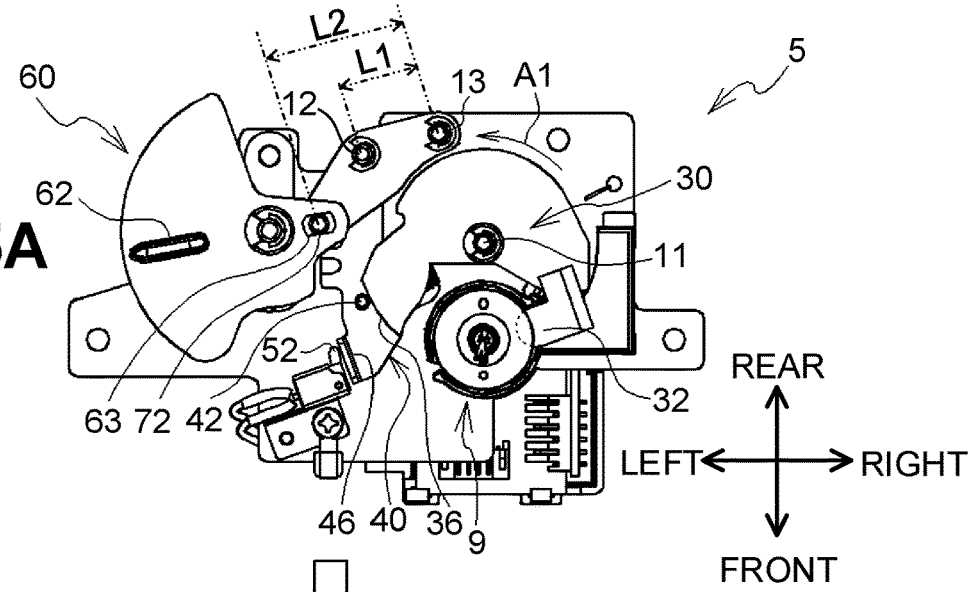
FIGS. 5A, 5B, and 5C illustrate a flow of operation of the lower thread winding device with a lever at a first adjusted rotation position.
Figure 5B:
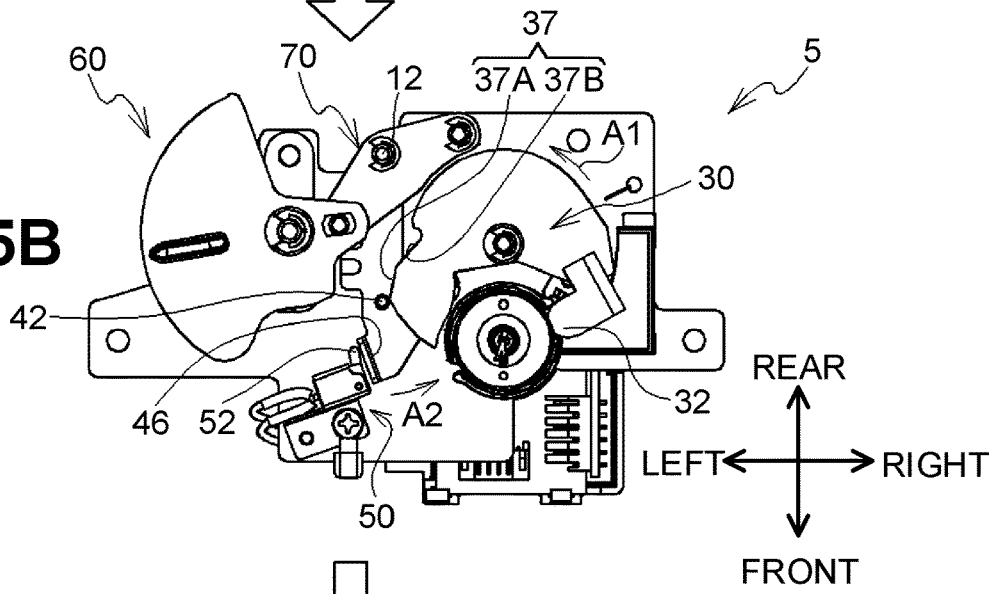
Figure 5C:
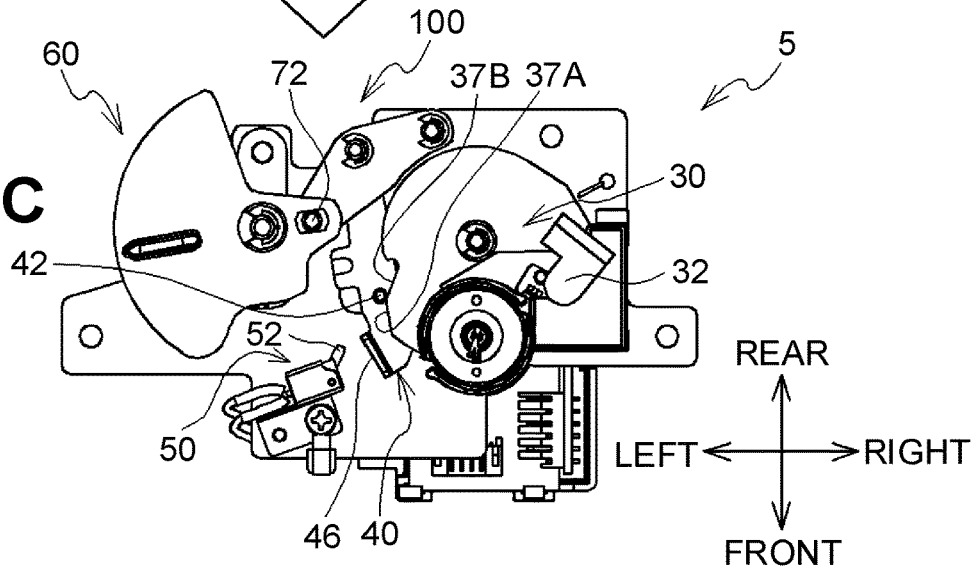
Figure 6A:
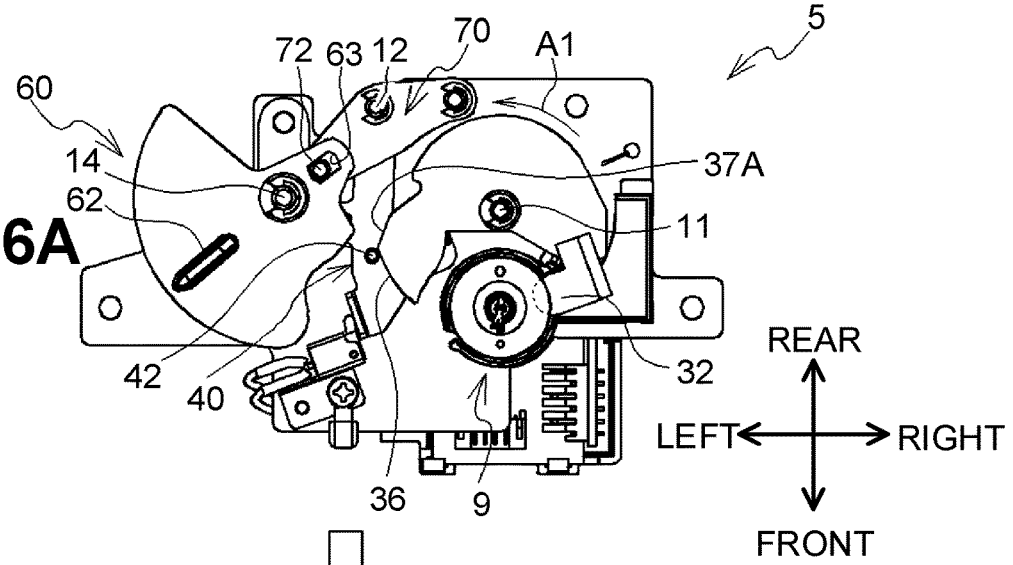
FIGS. 6A, 6B, and 6C illustrate a flow of operation of the lower thread winding device with a lever at a second adjusted rotation position.
Figure 6B:
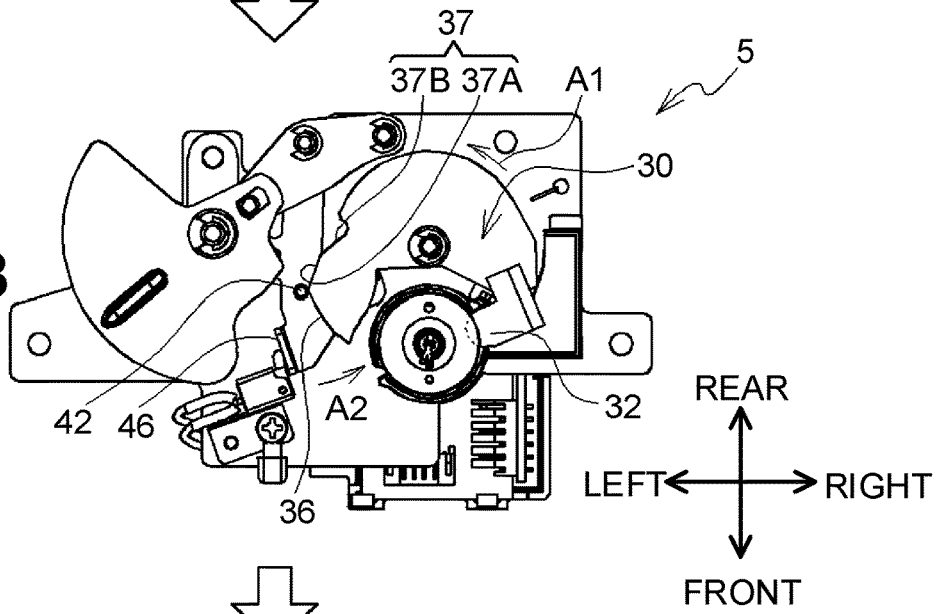
Figure 6C:
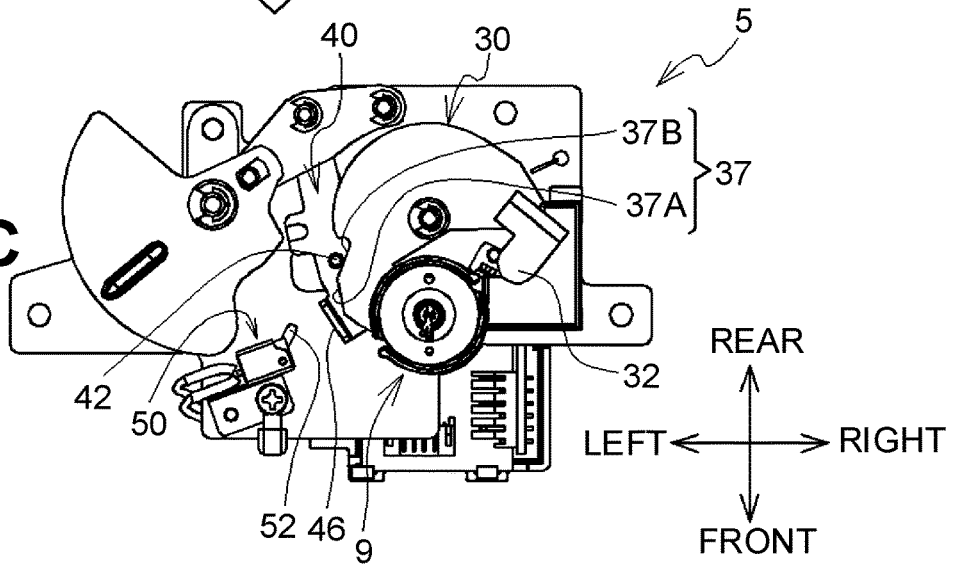

Referring to FIGS. 5 and 6, positional relationships between the sensor lever 30, the contact 40, and the lever 60 will be described. The sensor lever 30 rotates between an advanced rotation position (refer to FIGS. 5A and 6A) and a spaced rotation position (refer to FIGS. 5C and 6C). The advanced rotation position is a rotation position of the sensor lever 30 at which the contact portion 32 contacts the cylinder of the bobbin 9. The spaced rotation position is a rotation position of the sensor lever 30 at which the contact portion 32 is spaced apart from the bobbin 9 in a rear-right direction. The sensor lever 30 rotates, about the first rotation shaft 11 counterclockwise in plan view, from the advanced rotation position to the spaced rotation position.

The contact 40 rotates about the second rotation shaft 12 between a first position (refer to FIGS. 5A and 6A) and a second position (refer to FIGS. 5C and 6C). The first position is a rotation position of the contact 40 at which the pin 42 contacts the first outer peripheral portion 36 of the sensor lever 30. The second position is a rotation position of the contact 40 at which the pin 42 contacts the second outer peripheral portion 37 of the sensor lever 30. When the sensor lever 30 is at the advanced rotation position, the contact 40 is at the first position. When the sensor lever 30 is at the spaced rotation position, the contact 40 is at the second position. The contact 40 rotates, about the second rotation shaft 12 counterclockwise in plan view, from the first position to the second position.

In the following description, a position at which the pin 42 of the contact 40 at the first position contacts the first outer peripheral portion 36 is referred to as a "specific contact position" (refer to FIGS. 5A and 6A). When the pin 42 at the specific contact position contacts the first outer peripheral portion 36, the first outer peripheral portion 36 restricts the contact 40 urged by the urging member 16 from rotating toward the second position. In contrast, when the pin 42 contacts the second outer peripheral portion 37, the contact 40 urged by the urging member 16 rotates, with the pin 42 sliding the second outer peripheral portion 37, toward the second position.

The lever 60 rotates between a first adjusted rotation position (refer to FIGS. 5A to 5C) and a second adjusted rotation position (refer to FIGS. 6A to 6C). The first adjusted rotation position is a rotation position of the lever 60 at which a substantially central portion of the coupling hole 63 contacts the protruding pin 72. The second adjusted rotation position is a rotation position of the lever 60 at which an end of the coupling hole 63 closer to the fourth rotation shaft 14 contacts the protruding pin 72. The lever 60 rotates counterclockwise in plan view from the first adjusted rotation position to the second adjusted rotation position. Rotation of the lever 60 between the first adjusted rotation position and the second adjusted rotation position shifts the specific contact position of the pin 42. In this illustrative embodiment, as the rotation position of the lever 60 shifts toward the second adjusted rotation position, the specific contact position of the pin 42 shifts toward the second outer peripheral portion 37 (refer to FIGS. 5A and 6A).

Referring to FIG. 2, the detector 50 will be described. The detector 50 in this illustrative embodiment is a leaf switch. The detector 50 includes the movable portion 52 and an elastic member (not shown). The movable portion 52 is rotatable about a specific axis extending in the vertical direction. The elastic member urges the movable portion 52 in a predetermined direction. The predetermined direction is a clockwise direction about the specific axis in plan view and corresponds to an arrow B. When the contact 40 is at the first position (refer to FIG. 5A), the switch contact portion 46 contacts the movable portion 52, thereby restricting rotation of the movable portion 52 in the predetermined direction. At this time, the movable portion 52 is positioned at one end of a movable range. When the contact 40 is at the second position (refer to FIG. 5C), the switch contact portion 46 moves rightward away from the movable portion 52 which in turn moves to the other end of the movable range. The detector 50 outputs different detection results, depending on whether the movable portion 52 is at one end or at the other end of the movable range. In other words, the detector 50 outputs different detection results, depending on whether the contact 40 is at the first position or at the second position.

Figure 4:
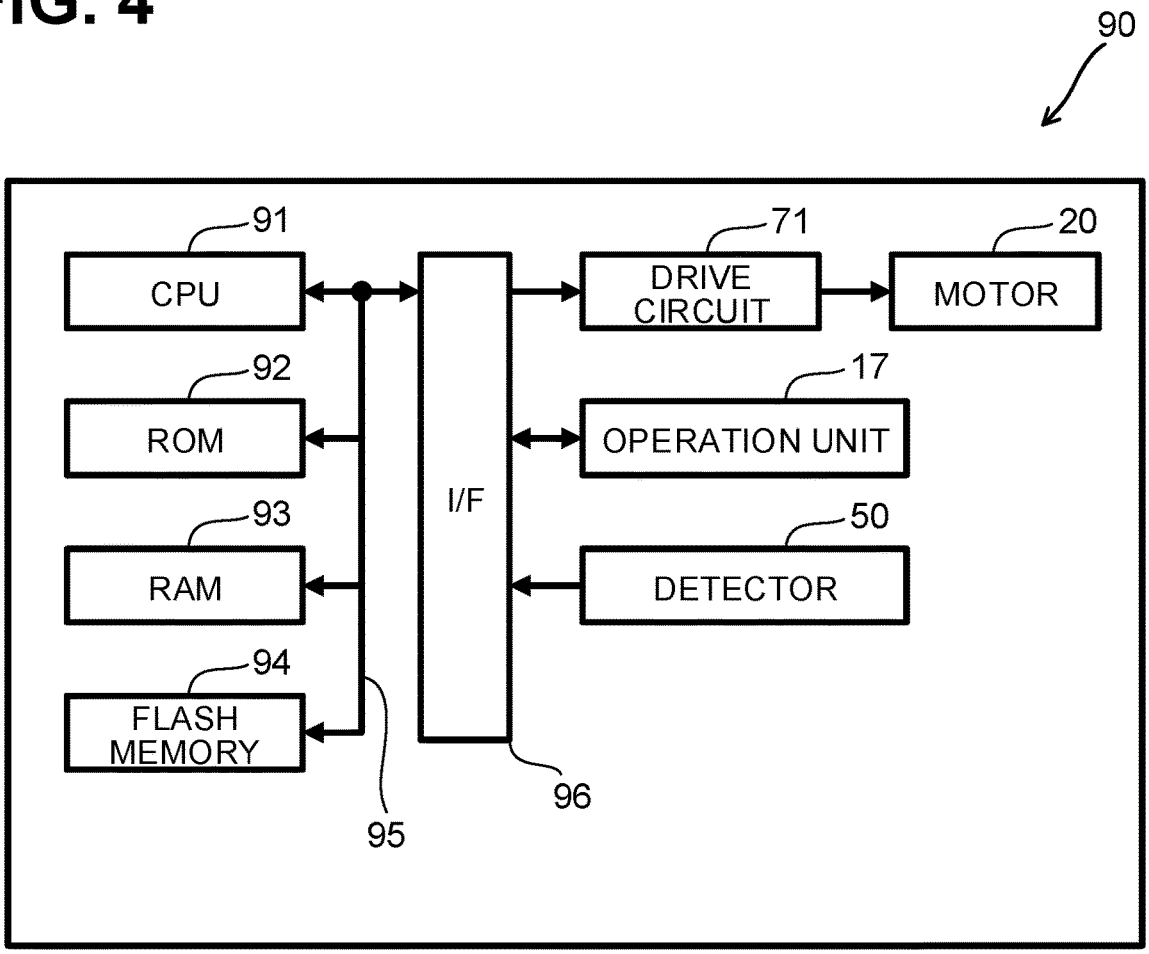
FIG. 4 is a block diagram showing the electrical configuration of a controller.

Referring to FIG. 4, the electrical configuration of a controller 90 will be described. The controller 90 is included in a sewing machine controller (not shown) for controlling operation of the sewing machine 1. The controller 90 includes a CPU 91, a ROM 92, a RAM 93, a flash memory 94, and an input/output interface (I/F) 96. The CPU 91 is connected, via a bus 95, to the ROM 92, the RAM 93, the flash memory 94, and the input/output I/F 96.

The CPU 91 conducts main control over the sewing machine 1 and the lower thread winding device 5 and executes various calculations and processing according to various programs stored in the ROM 92. The RAM 93 includes a storage area for storing calculation results calculated by the CPU 91. The flash memory 94 stores therein various parameters for the sewing machine 1 and the lower thread winding device 5 to execute various processes. A drive circuit 71, the operation unit 17, and the detector 50 are connected to the input/output I/F 96. The motor 20 is connected to the drive circuit 71. The CPU 91 controls driving of the motor 20 by sending control signals to the drive circuit 71. The operation unit 17 detects an operation result by a user and outputs a detection result to the CPU 91. The detector 50 outputs a detection result to the CPU 91. The detection result by the detector 50 is an ON signal or an OFF signal. The detection result by the detector 50 changes, depending on whether the movable portion 52 is at one end or at the other end of the movable range.

Referring to FIGS. 1, 4, and 5, operation of the lower thread winding device 5 when the lever 60 is at the first adjusted rotation position will be described. A user rotates the openable cover 2A to open the inside of the horizontal arm 2 and mounts the bobbin 9 on the thread winding shaft 10, and then ties a lower thread 22 drawn from the thread spool to the cylinder of the bobbin 9. Thereafter, the user holds the contact portion 32 to rotate the sensor lever 30 from the spaced rotation position to the advanced rotation position (refer to FIG. 5A). Upon operation of the operation unit 17 by the user, the CPU 91 starts driving the motor 20. The motor 20 is driven in such a direction that the lower thread 22 is wound on the bobbin 9. Even when the motor 20 is driven, the lever 60 and the link 70 remain stationary.

When the bobbin 9 rotates, upon driving of the motor 20, to wind the lower thread 22 on the cylinder, the contact portion 32 contacts the lower thread 22 instead of the cylinder of the bobbin 9. As the lower thread 22 is wound on the cylinder, a contact position between the contact portion 32 and the lower thread 22 gradually moves away from the thread winding shaft 10. This causes the sensor lever 30 to rotate toward the spaced rotation position (as shown by an arrow A1 in FIG. 5A) and the first outer peripheral portion 36 to slide relative to the pin 42. A contact position between the pin 42 and the first outer peripheral portion 36 gradually shifts toward the first rotation shaft 11. Consequently, the contact 40 urged by the urging member 16 gradually rotates about the second rotation shaft 12 from the first position toward the second position (refer to FIGS. 5A and 5B).

When the pin 42 contacts the flat surface 37A of the second outer peripheral portion 37, instead of the first outer peripheral portion 36, the pin 42 urged by the urging member 16 slides along the flat surface 37A while moving the cam piece 35 substantially rightward. This causes the contact 40 to rotate further toward the second position (as shown by an arrow A2 in FIG. 5B) and the sensor lever 30 to rotate further toward the spaced rotation position (as shown by an arrow A1 in FIG. 5B).

As shown in FIG. 5C, immediately after the switch contact portion 46 moves away from the movable portion 52, the contact 40 reaches the second position and the sensor lever 30 reaches the spaced rotation position. The contact 40 and the sensor lever 30 stop. The second position of the contact 40 when the lever 60 is at the first adjusted rotation position is a rotation position at which the pin 42 contacts a boundary between the flat surface 37A and the flat surface 37B. When the switch contact portion 46 moves away from the movable portion 52, the movable portion 52 rotates to the other end of the movable range, and the detection result by the detector 50 changes. The changed detection result by the detector 50 indicates that the contact 40 is at the second position. Upon receipt of the changed detection result by the detector 50, the CPU 91 stops driving the motor 20. The lower thread winding device 5 ceases to operate and a predetermined amount of the lower thread 22 is wounded on the cylinder of the bobbin 9.

Referring to FIGS. 2 and 6, operation of the lower thread winding device 5 when the lever 60 is at the second adjusted rotation position will be described. Hereinafter, a repetitive description of the same or similar operation of the lower thread winding device 5 described above will be omitted.

The user rotates the sensor lever 30 to the advanced rotation position and then hold the handle 62 to rotate the lever 60 from the first adjusted rotation position to the second adjusted rotation position. When the lever 60 is rotated, the irregularities 67 (refer to FIG. 3) slide relative to the contact member 66. Rotation of the lever 60 causes the link 70 to rotate about the third rotation shaft 13 clockwise in plan view. The link 70 moves, via the second rotation shaft 12, the contact 40 rearward. Consequently, the specific contact position of the pin 42 shifts more rearward (i.e., toward the flat surface 37A) than when the lever 60 is at the first adjusted rotation position. Thereafter, when the CPU 91 starts driving the motor 20, the lower thread 22 is wound on the bobbin 9 and the sensor lever 30 rotates counterclockwise in plan view (as shown in an arrow A1 in FIG. 6A).

After driving of the motor 20 is started, the pin 42 slides to a rear end of the first outer peripheral portion 36 (refer to FIG. 6B). A period of time taken, after the motor 20 is driven, for the pin 42 to contact the rear end of the first outer peripheral portion 36 is shorter than when the lever 60 is at the first adjusted rotation position. When the pin 42 slides the flat surface 37A instead of the first outer peripheral portion 36, the contact 40 rotates further toward the second position and the sensor lever 30 rotates further toward the spaced rotation position.

As shown in FIG. 6C, after the switch contact portion 46 moves away from the movable portion 52, the pin 42 slides the flat surface 37B instead of the flat surface 37A. Thereafter, the sensor lever 30 reaches the spaced rotation position and the contact 40 reaches the second position. The second position of the contact 40 when the lever 60 is at the second adjusted rotation position is a rotation position of the contact 40 at which the pin 42 contacts the flat surface 37B. A timing at which the switch contact portion 46 moves away from the movable portion 52 (i.e., a timing at which the detection result by the detector 50 changes) is earlier than when the lever 60 is at the first adjusted rotation position. Accordingly, the amount of the lower thread 22 wound on the bobbin 9 is less than when the lever 60 is at the first adjusted rotation position.

The user may stop the lever 60 at a rotation position between the first adjusted rotation position and the second adjusted rotation position to operate the lower thread winding device 5. In other words, the user is allowed to readily and freely adjust the amount of the lower thread 22 to be wound on the bobbin 9 by changing the rotation position of the lever 60.

As described above, when the lever 60 rotates between the first adjusted rotation position and the second adjusted rotation position, the specific contact position of the pin 42 shifts in a direction away from the flat surface 37A of the second outer peripheral portion 37 and in a direction toward the flat surface 37A. The user rotates the lever 60 to shift the specific contact position of the pin 42. This changes the rotation amount of the contact 40 necessary for the detector 50 to change the detection result. Accordingly, operation of the lever 60 by the user changes the amount of the lower thread 22 to be wound on the bobbin 9 until the controller 90 stops the motor 20 after starting driving the motor 20. The lower thread winding device 5 is thus achieved in which the user is allowed to adjust the amount of the lower thread 22 to be wound on the bobbin 9.

The cover 55 exposes the handle 62 which is a portion of the lever 60 and covers from above the contact 40. This may prevent the user from inadvertently touch the contact 40 and facilitate the user to properly operate the handle 62.

The lower thread winding device 5 includes the link mechanism 100. The link mechanism 100 may prevent a direct transmission of a rotation force of the lever 60 to the contact 40. The link mechanism 100 may prevent transmission of an excessive force to the contact 40, and thus the lower thread winding device 5 may prevent a failure of the contact 40.

The link mechanism 100 includes the link 70 rotatable about the third rotation shaft 13. The link mechanism 100 converts a rational moving force of the lever 60 to a rotational moving force of the link 70, thereby preventing a direct transmission of the force from the lever 60 to the contact 40.

The dimension L1 (refer to FIG. 5A) is less than the dimension L2 (refer to FIG. 5A). Namely, the distance between the second rotation shaft 12 and the third rotation shaft 13 is less than the distance between the coupling position of the lever 60 to the link 70 (i.e., the position of the protruding pin 72) and the third rotation shaft 13. When the lever 60 rotates, this makes a rotational moving amount, about the third rotation shaft 13, of the second rotation shaft 12 less than a rotational moving amount, about the third rotation shaft 13, of the coupling position of the lever 60 to the link 70. The lower thread winding device 5 is thus allowed to reduce a rotational moving amount of the contact 40 as the lever 60 rotationally moves, thereby allowing the user to finely adjust the specific contact position.

The lever 60 is rotatable about the fourth rotation shaft 14. The lower thread winding device 5 is thus allowed to shift the specific contact position by rotational movement of the lever 60.

The lower thread winding device 5 includes the contact member 66 configured to slidably contact the base 61 of the lever 60. The contact member 66 in contact with the base 61 makes the lever 60 less easy to rotate, thereby allowing the user to finely adjust the rotation position of the lever 60. Accordingly, the user is allowed to finely adjust the amount of the lower thread 22 to be wound on the bobbin 9 by the lower thread winding device 5.

The contact member 66 press-contacts the irregularities 67 of the base 61. This makes the lever 60 much less easy to rotate and facilitates finer adjustment of the rotation position of the lever 60 in the lower thread wining device 5.

The detector 50 issues different detection results, depending on whether the movable portion 52 and the switch contact portion 46 contact each other. The detector 50 readily detects whether the contact 40 is at the first position or at the second position.

The disclosure may not be limited to the above-described illustrative embodiment, and various changes may be applied therein. The lower thread winding device 5 may be a single unit separate from the sewing machine 1. In this case, the lower thread winding device 5 may be easily portable. The lever 60 may be lineally movable, for example, along the front-rear direction, instead of rotationally movable. In this case, the irregularities 67 extends lineally.

The disposition and orientation of the lower thread winding device 5 may not be limited to the above-described illustrative embodiment. For example, the lower thread winding device 5 may be disposed such that the thread winding shaft 10, the first rotation shaft 11, the second rotation shaft 12, and the third rotation shaft 13 extend in the left-right direction. In this case, if the pin 42 contacts from above the cam piece 35, the lower thread winding device 5 may lack the urging member 16. The pin 42 press-contacts the cam piece 35 due to the own weight of the contact 40. The first outer peripheral portion 36 may be an arc of a perfect circle about the first rotation shaft 11. The second outer peripheral portion 37 may be curved. In this case also, a distance between the second outer peripheral portion 37 and the first rotation shaft 11 changes along a rotation direction about the first rotation shaft 11. The distance between the second outer peripheral portion 37 and the first rotation shaft 11 may get longer toward a clockwise side about the first rotation shaft 11 in plan view. In this case, the contact 40 at the first position rotates about the third rotation shaft 13 clockwise in plan view to reach the second position. The cam piece 35 may be formed, for example, at an outer peripheral potion of the contact portion 32. In this case, the dispositions of the contact 40 and other elements are changed as appropriate.

The third rotation shaft 13 may be omitted. In this case, the link 70 may be rotatably disposed at the first rotation shaft 11. In this modification, the first rotation shaft 11 is an example of a third rotation shaft according to an aspect of the disclosure. Alternatively, when the third rotation shaft 13 is omitted, the link 70 may be rotatably disposed at only the second rotation shaft 12. In this modification, the second rotation shaft 12 is an example of a third rotation shaft according to an aspect of the disclosure. The fourth rotation shaft 14 may be omitted. In this case, the lever 60 may be rotatably disposed at the first rotation shaft 11. In this modification, the first rotation shaft 11 is an example of a fourth rotation shaft of the disclosure.

The movable portion 52 of the detector 50 may be contactable with, for example, the contact portion 32, instead of the switch contact portion 46. In this case, the movable portion 52 may be spaced apart from the contact portion 32 when the sensor lever 30 is at the advanced rotation position, and may be in contact with the contact portion 32 when the sensor lever 30 is at the spaced rotation position. The detector 50 may be, for example, an optical sensor, instead of a limit switch. The link 70, instead of the lever 60, may have the coupling hole 63. In this case, the coupling hole 63 is elongate in a radial direction relative to the third rotation shaft 13, and the protruding pin 72 protrudes downward from the lever 60.

What is claimed is:

1. A lower thread winding device for winding a lower thread on a bobbin, the lower thread winding device comprising:

a thread winding shaft on which the bobbin is mounted;

a motor configured to rotate the thread winding shaft;

a sensor lever rotatable about a first rotation shaft and including:

a contact portion contactable with the lower thread wound on the bobbin and configured to rotate about the first rotation shaft in a direction toward the bobbin and in a direction away from the bobbin, and a cam piece formed along a rotation direction about the first rotation shaft and including a first outer peripheral portion and a second outer peripheral portion, a distance between the second outer peripheral portion and the first rotation shaft changing along the rotation direction;

a contact rotatable about a second rotation shaft different from the first rotation shaft and including a pin configured to contact the cam piece, the contact being configured to, when the sensor lever rotates in a rotation direction in which the contact portion moves away from the bobbin, rotate from a first position at which the pin contacts the first outer peripheral portion to a second position at which the pin contacts the second outer peripheral portion;

a detector configured to output different detection results, depending on whether the contact is at the first position or at the second position;

a lever coupled to the contact and configured to shift a position of the pin located when the contact is at the first position in a direction toward the second outer peripheral portion and in a direction away from the second outer peripheral portion;

a controller configured to:

when the contact is at the first position, drive the motor in a driving direction in which the lower thread is wound on the bobbin, and upon receipt of a detection result indicating that the contact is at the second position, stop driving the motor; and a link mechanism coupled to the lever and the contact, and configured to transmit a moving force of the lever to the contact.

2. The lower thread winding device according to claim 1, further comprising a cover which covers the contact and exposes a portion of the lever.

3. The lower thread winding device according to claim 1, wherein the link mechanism is rotatable about a third rotation shaft and slidably coupled to the lever, and includes a link coupled to the contact.

4. The lower thread winding device according to claim 3, wherein the link includes the second rotation shaft disposed at such a position that a distance between the second rotation shaft and the third rotation shaft is less than a distance between a coupling position of the lever to the link and the third rotation shaft.

5. The lower thread winding device according to claim 1, wherein the lever is configured to rotate about a fourth rotation shaft different from the second rotation shaft.

6. The lower thread winding device according to claim 1, further comprising a contact member fixed to a predetermined position and configured to be slidably contact the lever.

7. The lower thread winding device according to claim 6, wherein the lever includes irregularities extending along a moving direction of the lever, and the contact member is configured to press-contact the irregularities.

8. The lower thread winding device according to claim 1, wherein the detector is a leaf switch which includes a movable portion urged toward a predetermined direction, and outputs different detection results depending on a position of the movable portion, and wherein the contact includes a switch contact portion configured to:

when the contact is at the first position, contact the movable portion from a downstream side in the predetermined direction to restrict the movable portion from moving in the predetermined direction, and when the contact is at the second position, move away from the movable portion.

* * * * *